US010018310B2

(12) United States Patent
Kuepper et al.

(10) Patent No.: US 10,018,310 B2
(45) Date of Patent: Jul. 10, 2018

(54) LED LAMP UNIT, IN PARTICULAR FOR AUTOMOTIVE LAMPS

(71) Applicant: KONINKLIJKE PHILIPS N.V., Eindhoven (NL)

(72) Inventors: Lukas Kuepper, Aachen (DE); Mohammad Mirsadeghi, Eindhoven (NL); Gunnar Luettgens, Aachen (DE); Gordon Patrick Rudolf Elger, Aachen (DE); Nadin Roesler, Veldhoven (NL); Aldo Tralli, Eindhoven (NL)

(73) Assignee: Lumileds LLC, San Jose, CA (US)

( * ) Notice: Subject to any disclaimer, the term of this patent is extended or adjusted under 35 U.S.C. 154(b) by 268 days.

(21) Appl. No.: 14/405,299

(22) PCT Filed: Jun. 3, 2013

(86) PCT No.: PCT/IB2013/054568

§ 371 (c)(1),
(2) Date: Dec. 3, 2014

(87) PCT Pub. No.: WO2013/182973

PCT Pub. Date: Dec. 12, 2013

(65) Prior Publication Data

US 2015/0146447 A1 May 28, 2015

Related U.S. Application Data

(60) Provisional application No. 61/655,001, filed on Jun. 4, 2012.

(51) Int. Cl.
*F21S 8/10* (2006.01)
*F21V 21/00* (2006.01)
(Continued)

(52) U.S. Cl.
CPC ..... *F21K 9/135* (2013.01); *F21K 9/232* (2016.08); *F21S 41/141* (2018.01);
(Continued)

(58) Field of Classification Search
CPC .... F21K 9/00; F21K 9/135; F21K 9/20; F21S 48/1109; F21S 48/115; F21S 48/1159;
(Continued)

(56) References Cited

U.S. PATENT DOCUMENTS 6,962,428 B2 11/2005 Natsume
7,086,767 B2 * 8/2006 Sidwell ..... F21V 3/00 362/249.06
(Continued)

FOREIGN PATENT DOCUMENTS

CN 201575385 U 9/2010
DE 102006037481 A1 2/2008
(Continued)

OTHER PUBLICATIONS

EPO as ISA, PCT/IB2013/054568 filed Jun. 3, 2013, "International Search Report and Written Opinion" dated Nov. 12, 2013, 11 pages.
(Continued)

*Primary Examiner* — Jason Moon Han

(57) ABSTRACT

The present invention relates to a LED lamp unit (10) comprising at least two LED light sources (2) arranged between a heat sink (3) and an electrical connector base at two opposing sides of the lamp unit (10) to emit in opposed half spaces. The proposed LED lamp unit can be constructed in a very compact form in order to replace known halogen, xenon and incandescent bulbs without changing the construction of the reflector and mechanical parts in a head lamp or signaling lamp.

13 Claims, 4 Drawing Sheets

(51) Int. Cl.

| | |
|---|---|
| ***F21K 99/00*** | (2016.01) |
| ***F21V 29/67*** | (2015.01) |
| ***F21V 29/74*** | (2015.01) |
| ***F21V 23/06*** | (2006.01) |
| ***F21K 9/232*** | (2016.01) |
| ***F21S 41/19*** | (2018.01) |
| ***F21S 41/141*** | (2018.01) |
| ***F21S 41/147*** | (2018.01) |
| ***F21S 41/32*** | (2018.01) |
| ***F21S 43/19*** | (2018.01) |
| ***F21S 43/14*** | (2018.01) |
| ***F21S 43/31*** | (2018.01) |
| ***F21S 45/43*** | (2018.01) |
| *F21Y 115/10* | (2016.01) |

(52) U.S. Cl.
CPC ..... *F21S 41/147* (2018.01); *F21S 41/192* (2018.01); *F21S 41/32* (2018.01); *F21S 43/14* (2018.01); *F21S 43/195* (2018.01); *F21S 43/31* (2018.01); *F21S 45/43* (2018.01); *F21V 23/06* (2013.01); *F21V 29/677* (2015.01); *F21V 29/74* (2015.01); *F21Y 2115/10* (2016.08)

(58) Field of Classification Search
CPC .... F21S 48/1317; F21S 48/212; F21S 48/215; F21S 48/234; F21S 48/325; F21V 23/06; F21V 29/677; F21V 29/74
USPC ..... 362/249.02, 394, 545–548
See application file for complete search history.

(56) References Cited

U.S. PATENT DOCUMENTS

| | | | | |
|---|---|---|---|---|
| 7,314,291 | B2 * | 1/2008 | Tain | F21K 9/00 257/99 |
| 8,845,161 | B2 * | 9/2014 | DiPenti | F21S 48/1104 362/373 |
| 2003/0053318 | A1 | 3/2003 | Amano | |
| 2003/0227774 | A1 | 12/2003 | Martin et al. | |
| 2005/0024875 | A1 | 2/2005 | Zhang | |
| 2005/0025875 | A1 | 2/2005 | Plank et al. | |
| 2006/0028814 | A1 | 2/2006 | Smith | |
| 2007/0297183 | A1 | 12/2007 | Coushaine | |
| 2009/0002997 | A1 | 1/2009 | Koester | |
| 2009/0097247 | A1 | 4/2009 | Tseng et al. | |
| 2010/0207502 | A1 | 8/2010 | Cao et al. | |
| 2010/0244649 | A1 | 9/2010 | Inaba | |
| 2012/0281403 | A1 * | 11/2012 | Kang | F21V 3/00 362/237 |

FOREIGN PATENT DOCUMENTS

| | | | | |
|---|---|---|---|---|
| DE | 102007043961 | A1 | 3/2009 | |
| EP | 1371901 | A2 | 12/2003 | |
| EP | 1500868 | A2 | 1/2010 | |
| EP | 2148133 | A2 | 1/2010 | |
| JP | 2004111355 | A | 4/2004 | |
| JP | 2006156301 | A | 6/2006 | |
| JP | 2010118325 | A | 5/2010 | |
| RU | 103343 | U1 | 4/2011 | |
| WO | WO 2009040703 | A2 * | 4/2009 | F21K 9/233 |
| WO | 2011111476 | A1 | 9/2011 | |

OTHER PUBLICATIONS

First Office Action dated May 23, 2016, China Patent Application No. 201380029356.1, 17 pages.
Decision of Rejection dated Dec. 22, 2016, China Patent Application No. 201380029356.1, 11 pages.
Office Action dated Mar. 14, 2017, Japan Patent Application No. 2015-514670, 3 pages.
CN Notice of Reexamination dated Aug. 1, 2017, China Patent Application No. 201380029356.1, 19 pages.
Final Notice of Reason for Rejection dated Sep. 26, 2017, Japan Patent Application No. 2015-514670, 9 pages.
Office Action dated Jun. 19, 2017, Russia Patent Application No. 2014153445, 9 pages.
Reexamination Decision dated Nov. 8, 2017, China Patent Application No. 201380029356.1, 33 pages.

* cited by examiner

LED LAMP UNIT, IN PARTICULAR FOR AUTOMOTIVE LAMPS

CROSS-REFERENCE TO PRIOR APPLICATIONS

This application is the U.S. National Phase application under 35 U.S.C. § 371 of International Application No. PCT/IB13/054568, filed on Jun. 03, 2013, which claims the benefit of U.S. Provisional Patent Application No. 61/655,001, filed on Jun. 04, 2012. These applications are hereby incorporated by reference herein.

FIELD OF THE INVENTION

The present invention relates to a LED lamp unit comprising at least two LED light sources arranged at two opposing sides of the lamp unit to emit in opposed half spaces, as well as a headlamp or signaling lamp (=automotive lamps), wherein the LED lamp unit is completely arranged inside a volume at least partly surrounded by a reflector of the automotive lamp such that light emitted from the LED light sources is directed by said reflector towards a light emission direction of said lamp.

BACKGROUND OF THE INVENTION

Halogen, xenon and incandescent bulbs used for automotive headlamp applications have high brightness filaments with precise geometry. On the other hand the energy efficiency as well as the lifetime is significantly lower compared to other light source technologies, especially LED technology.

Incandescent bulbs that are used for automotive signaling lamps have less brightness and the tolerances of the geometry are less critical. However due to the limited lifetime, it is of interest to make used of LED technology for signaling lamps.

Currently LED's are available with brightness levels comparable or even significantly higher compared to automotive halogen and incandescent bulbs. While LED's emit only in one half of the sphere, the coil of an halogen and incandescent bulb emits in the complete hemisphere. Thus the headlamp optic developed for filament bulbs does not fit to the emission pattern of a single LED. Multiple high brightness LED's have to be arranged in such geometry that the emission pattern as well as the geometry resembles the corresponding emission pattern and geometry of a filament bulb and makes efficient use of the existing automotive optical components.

U.S. 2010/0244649 A1 discloses a LED lamp unit for automotive lamps in which two LED's are mounted at two opposing sides of a common mounting plate to emit in opposed half spaces. The mounting plate is thermally connected at one side to a heat sink comprising several cooling fins. A fan is arranged at the backside of the heat sink to generate a forced air cooling of the heat sink. In the proposed automotive lamp, the two LED's are arranged inside of the volume surrounded by the reflector of the lamp whereas the large heat sink and the fan are arranged outside. Such a lamp unit requires a different construction of the lamp compared with the known constructions using halogen and incandescent bulbs.

SUMMARY OF THE INVENTION

It is an object of the present invention to provide a lamp unit which can simply replace known halogen and incandescent bulbs in automotive lamps without changing the construction of such a lamp.

The object is achieved with the LED lamp unit according to claim 1. Claim 12 relates to an automotive lamp which can be a signaling or headlamp including the LED lamp unit according to claim 1. Advantageous embodiments of the LED lamp unit and headlamp or signaling lamp are subject matter of the dependent claims or are disclosed in the subsequent portions of the description and preferred embodiment.

The proposed LED lamp unit comprises at least two LED light sources, an electrical connector base for electrical connecting the LED light sources and a heat sink in thermal contact with the support member(s) of the LED light sources. The LED light sources are arranged between the electrical connector base and at least a portion of the heat sink at two opposing sides of the lamp unit to emit in opposed half spaces. Optionally, an electrically operated fan for forced air cooling of the heat sink can be arranged at the heat sink in order to increase the cooling power.

In an advantageous embodiment the at least two LED light sources are arranged on two opposing sides of a common plate-like support member, in particular a mounting plate, to emit in opposed half spaces or directions. The electrical connector base and the heat sink in thermal contact with the support member are arranged on opposing side edges of the support member.

When the proposed LED lamp is mounted in a headlamp or signaling lamp, at least a portion of the heat sink is thus arranged between the LEDs and the light emission side of the headlamp, blocking part of the light emitted by the LEDs directly towards this light emission side. This has the advantage that the dazzling effect of the lamp is reduced.

With such a construction of the LED lamp unit an illumination into both opposing half spheres is achieved similar to the illumination of a halogen and incandescent bulb. The arrangement of at least part of the heat sink on the side opposite to the electrical connection base allows an elongated shape an dimensions similar to those of known halogen and incandescent bulbs for automotive lamps. The LED lamp can thus simply replace known halogen and incandescent bulbs in automotive lamps without changing the construction of such a lamp.

In a preferred embodiment two separate heat sinks are arranged at two opposing edges of the plate-like support member in thermal contact with the support member. One of these heat sinks is thus arranged between the electrical connector base and the support member. The heat sinks may comprise several cooling fins. In order to improve the cooling power, an electrically operated fan is arranged at one or both of the heat sinks such that the fan generates a flow of cooling gas, in particular cooling air, through gaps between the cooling fins of the heat sink towards the LED light sources.

With this arrangement of two heat sinks at both opposing edges of the common plate-like support member an elongated shape of the LED lamp unit can also be achieved similar to the elongated shape of a halogen or incandescent bulb. The use of fans at both opposing ends of the heat sinks provides an effective cooling of the whole LED lamp unit. Due to this construction and effective cooling such a LED lamp unit can be designed with small dimensions similar to those of known halogen and incandescent bulbs for automotive lamps even if operated with high power and can thus replace such lamps without any further modification of the optical system and construction of the lamp.

In a preferred embodiment, the two heat sinks are formed such that the gaps between the cooling fins are opened towards the support member/LED light sources and towards the fans. These gaps thus form continuous cooling channels extending between the fan and the LED light sources. With such an arrangement the cooling gas or cooling air is forced from two opposing sides through the heat sinks towards the LED light sources and also directly cools these LED light sources. The counter flow of the cooling gas or cooling air from both sides results in a further improved cooling of the lamp unit. Due to this efficient cooling the heat sinks can be dimensioned in an even compacter form and/or the lamp can be driven with higher electrical power.

Preferably the whole LED lamp unit even if including the two fans, the two heat sinks and the intermediate support member with the LED light sources has a dimension in a longitudinal direction, i.e. the direction between the axes of the two fans, of less than 80 mm, more preferably of ≤50 mm, and a diameter perpendicular to this longitudinal direction of less than 20 mm, more preferably ≤15 mm. The diameter in this context refers to the direction of longest extension of the lamp unit perpendicular to the above longitudinal direction.

The support member is preferably formed integrally with the heat sink(s) but may also be mechanically connected in any other way to the heat sink(s). The support member is made of a thermally high conductive material, preferably of a metal plate.

The proposed LED lamp unit may replace for example commonly used H7 bulbs in automotive headlamps or in future even Xenon high intensity discharge bulbs. Nevertheless, the LED lamp unit may also be used in other lamps, in particular in cornering light or fog light reflectors.

A proposed headlamp or signaling lamp comprises at least a reflector and the proposed LED lamp unit. In such a headlamp or signaling lamp the LED lamp unit is completely arranged inside of the volume surrounded by the reflector, such that light emitted by the LED light sources is directed by said reflector towards the light emission direction of the lamp.

BRIEF DESCRIPTION OF THE DRAWINGS

These and other aspects of the invention will be apparent from and elucidated with reference to the embodiment described herein after. In the drawings.

DETAILED DESCRIPTION OF EMBODIMENTS

Figure 1:
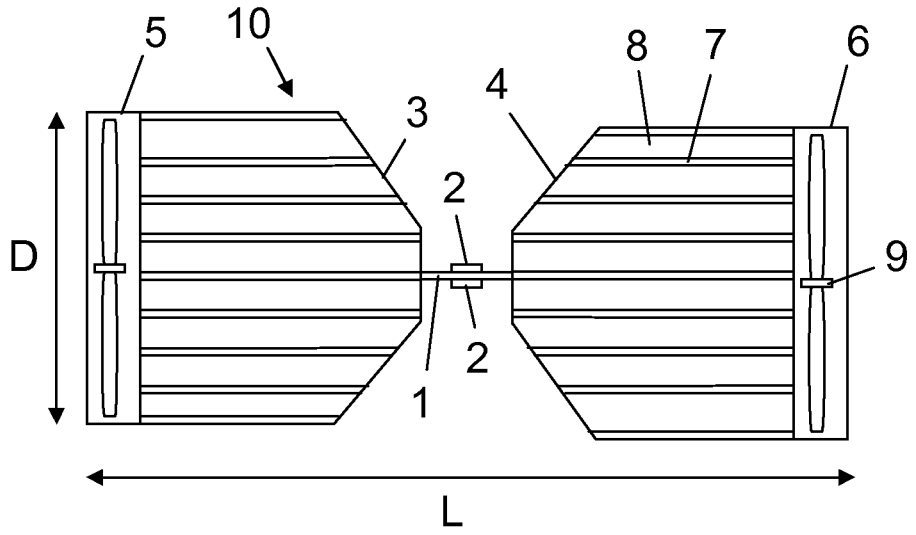
FIG. 1 shows a sectional view of an example of the LED lamp unit according to the invention.

FIG. 1 shows an example of the proposed LED lamp unit in a sectional view. In this example the LED lamp unit 10 comprises two high brightness LED's 2 mounted back to back on a very thin metal plate 1 and emitting in opposite directions or half spaces. A heat sink 3, 4 is mounted perpendicular to the metal plate 1 or LED surfaces on opposite sides at the edges of the metal plate 1. The heat sinks 3, 4 comprise several cooling fins 7 extending between the LED's 2 and the fans 5, 6 mounted at the backsides of the heat sinks 3, 4. The gaps 8 formed between the cooling fins 7 of the heat sinks 3, 4 are opened towards the fans 5, 6 and towards the LED light sources 2. With such an arrangement, a maximum cooling effect can be achieved by blowing air in opposite directions toward the LED's 2.

In the embodiment of FIG. 1, the heat sinks are tapered at their ends facing the LED's 2 in order to achieve the emission of the LED light in a large solid angle. The electrical connections to the LED's and the fans are as well as the electrical connector base are not shown in the figure. These electrical connections may be made by isolated lines attached to the metal plate 1 and the heat sinks 3, 4 or to cooling fins 7 of these heat sinks.

The whole lamp unit 10 is designed to have a dimension which fits in every state of the art automotive low beam, high beam, cornering light or fog light reflector. Considering a H7 retrofit for example, the maximum diameter D of the heat sink 3, 4 plus fan 5, 6 is 15 mm. The maximum length L of the LED lamp unit measured along the longitudinal direction connecting the axes 9 of the fans 5, 6—including the heat sinks and fans—is 50 mm. When introducing such a LED lamp unit in a H7 headlamp a sharp cut offline can be achieved and a legal low beam pattern is possible at a fraction of the power consumption of the corresponding halogen or incandescent light source.

Figure 2:
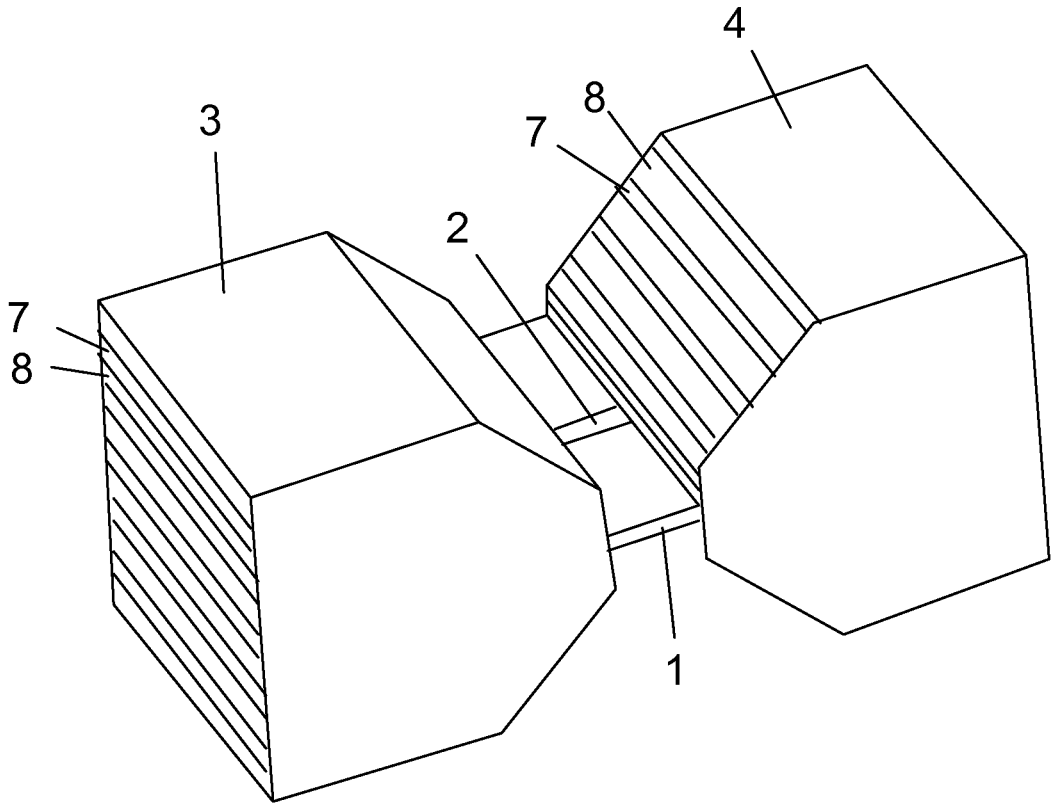
FIG. 2 shows a perspective view of a part of the lamp unit without the fans.

FIG. 2 shows a perspective view of an example of such a lamp unit in which the fans 5, 6 are not depicted. In the figure, the heat sinks 3, 4, the metal plate 1 forming the support member as well as one of the LED's 2 can be recognized. The figure schematically also shows the cooling fins 7 and gaps 8 between these cooling fins.

Figure 3:
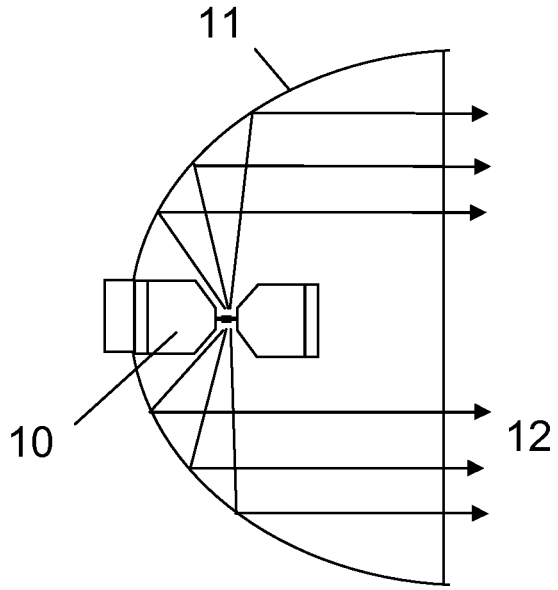
FIG. 3 schematically shows an arrangement of the proposed LED lamp unit in a headlamp lamp.
Figure 6:
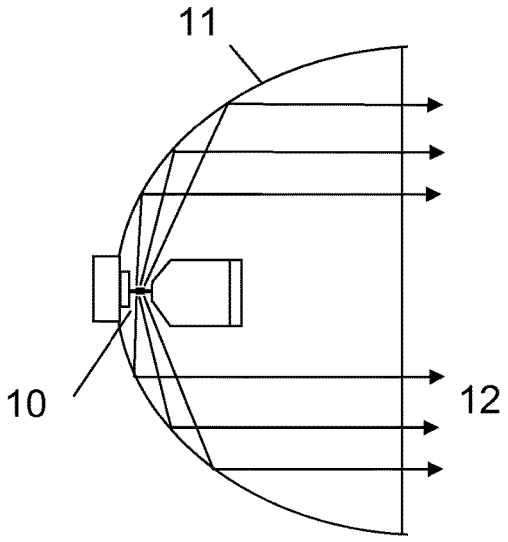
FIG. 6 schematically shows an arrangement of a further embodiment of the proposed LED lamp unit in a headlamp lamp.

FIG. 3 and FIG. 6 show examples of a headlamp in which such a lamp unit 10 is mounted instead of an halogen bulb. FIG. 3 refers to a lamp unit with two heat sinks, FIG. 6 to a lamp unit with only one heat sink. The headlamp comprises a reflector 11 for reflecting the light emitted by the LED's of lamp unit 10 towards the emission direction 12 of the automotive lamp. The provision of only one heat sink on the emission side of the lamp has the advantage that a light distribution of the emission of the lamp can be achieved which is identical to the light distribution when using a halogen or incandescent bulb. In case of two heat sinks as in FIG. 3, a portion of the LED light might be blocked by the second (inner) heat sink which is necessary to achieve such identical light distribution with the reflector.

In the following section, the feasibility of the proposed solution is shown by means of a case study performed in the simulation environment ANSYS. Assuming the H7 lamp of FIG. 4 has to be replaced with the designated available space. The white area shown is the available space that can be used for placing LEDs, heat sink and two fans. All these components should not overlap with the hatched area shown by solid parallel lines otherwise it will be an optical barrier. The dimensions indicated in the figure are in millimeters.

Figure 4:
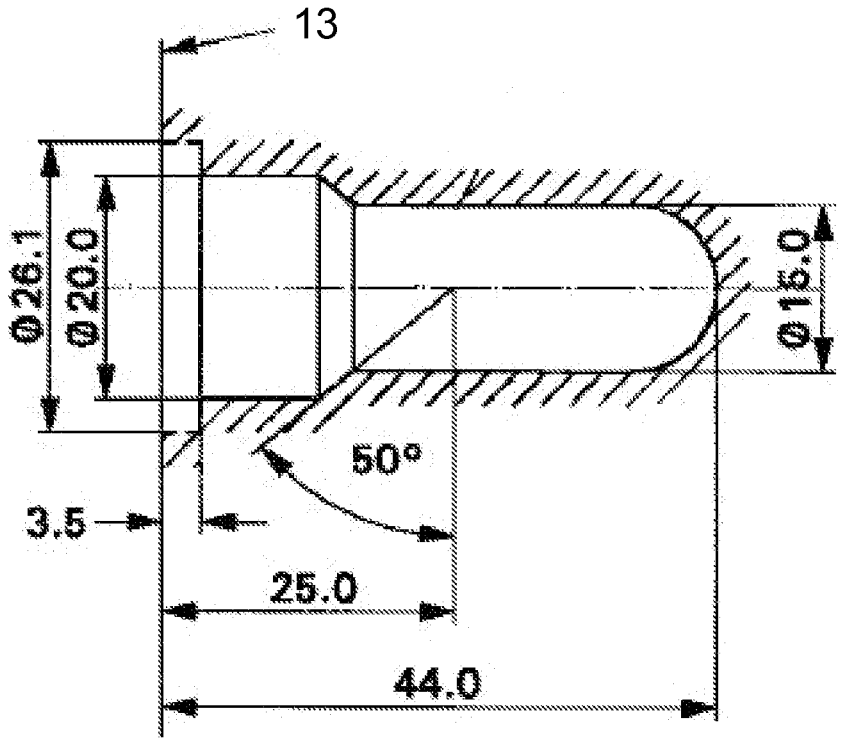
FIG. 4 shows a view of a halogen lamp which is to be replaced by a LED lamp.
Figure 5:
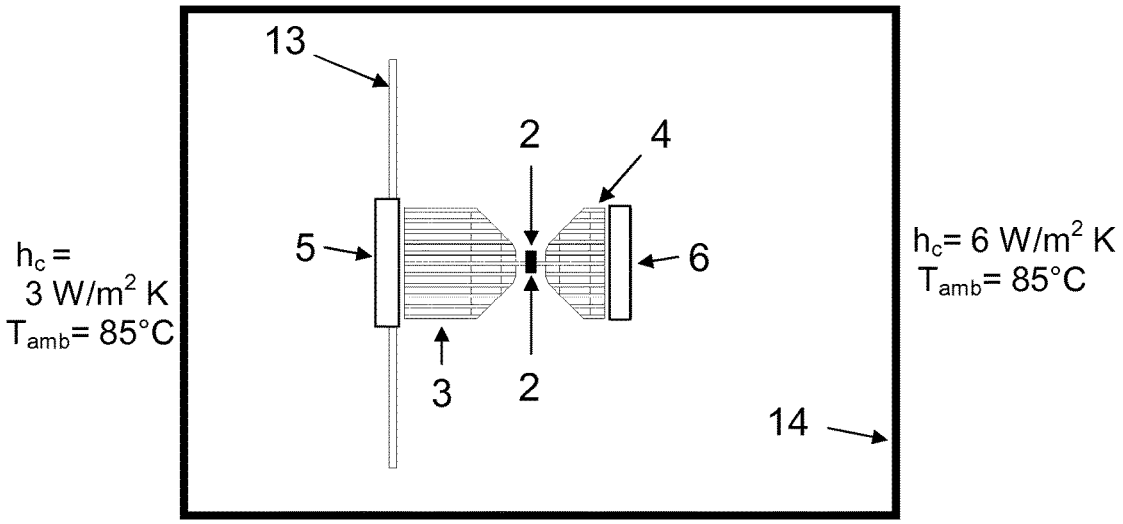
FIG. 5 shows an example of a LED lamp according to the invention replacing the halogen lamp of FIG. 4.

The heat sink design for such system is shown in FIG. 5. The two fans 5, 6 are shown at the two ends of the heat sink 3, 4 by rectangles schematically. These fans 5, 6 are located 1 mm away from the heat sink 3, 4. As shown the LEDs 2 are placed on the two opposite sides of the base plate 1 of the heat sink. The total heat dissipation of these LEDs 2 is assumed to be 6 W. The reference plane 13 in FIG. 4 is the separation area between the front and back side of halogen lamp and this is modeled by a separation plane 13 shown in FIG. 5. The heat sink 3, 4 including the base plate 1 is made of copper with thermal conductivity of 400 W/mK. As shown in FIG. 5, these components are placed in an internal air domain 14 with the length, width and depth of 110 mm×75 mm×40 mm, respectively.

The characteristics of fan 5 are identical to UF3H3-700 which is a sunon fan with the maximum air flow of 16.27 1/min at zero static pressure. Fan 6 is chosen to be UF3F3-700 from the same fan supplier with the maximum air flow of 8.75 1/min at zero static pressure. The pressure versus flow rate curves of these fans were taken into account in the simulation.

Obviously, the left side of FIG. 4 is the back side of the car lamp where it is exposed to temperature and flow pattern caused by car engine. The right side of FIG. 4 is exposed to outdoor environment. In order to simulate these external conditions the boundary conditions depicted in FIG. 5 is applied. The simulation was carried out in ANSYS CFX simulation environment using Shear stress transport turbulence model. The surface to surface radiation model was included to account for radiation transport mechanisms.

As a result of the simulation a maximum temperature of 140° C. could be reached at the LED positions that could be easily handled by LUXEON F LEDs. The heat removal from the heat sink to the air occurs in two steps:

1. Heat removal from the cooling channels of the heat sink to the air
2. Heat removal from the middle of the heat sink at LED positions The first heat transfer mechanism is enhanced through fans operating towards each other, leading to "boundary layer thinning" which improves the heat transfer coefficient on the surface of the cooling channels. The second heat transfer mechanism is again enhanced through the fans operating in this unique configuration. Two main air flow streams meet each other at high speed in the middle of the heat sink where LEDs are positioned, leading to "boundary layer removal" at the hottest point of the system which highly increases the heat transfer rate. This phenomenon is similar to jet cooling of hot spots where the boundary layer is removed through impinging air flow on a perpendicular surface. In this invention, the perpendicular surface is created or mimicked by a fan operating in an opposing direction.

Figure 7:
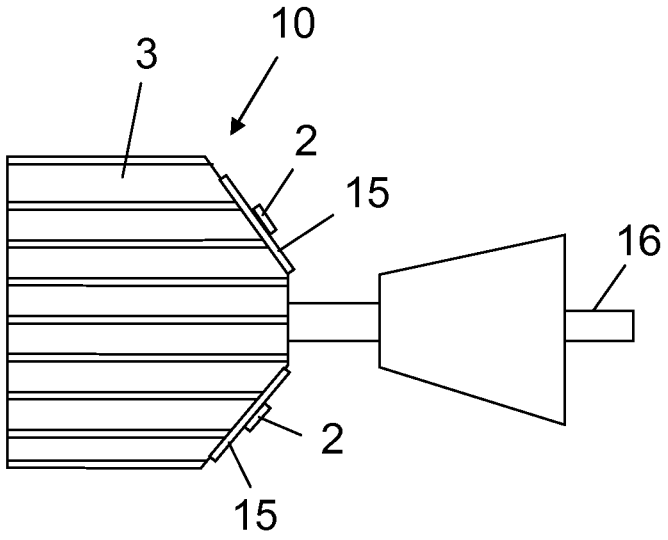
FIG. 7 schematically shows a sectional view of a further example of the LED lamp unit according to the invention.

FIG. 7 shows a further example of the proposed LED lamp unit in a sectional view. In this example two high brightness LED's 2 are mounted on separate support members 15 which are attached in this example at an angle of 120° to one another on a side face or the heat sink 3. This angle is not restricted to 120° and is preferably selected in the range between 20° and 160°. The heat sink is connected to the electrical connector base 16. Due to this arrangement the LED's also emit in opposing half spaces (to the upper side and to the lower side in the figure). Such an embodiment is advantageous for the use in a signaling lamp since most of the light emitted by the LED's 2 is directed to the central portion of the reflector (not shown in the figure) and is thus emitted by reflection at the reflector towards the emission direction of the lamp.

While the invention has been illustrated and described in detail in the drawings and forgoing description, such illustration and description are to be considered illustrative or exemplary and not restrictive. The invention is not limited to the disclosed embodiments. Other variations to the disclosed embodiments can be understood and effected by those skilled in the art in practicing the claimed invention, from a study of the drawings, the disclosure, and the appended claims. The heat sinks may also be formed different than in the figures. The gaps formed between the cooling fins may extend parallel to one another and parallel to the longitudinal direction of the lamp unit. Nevertheless, these gaps may also be inclined to one another and to this longitudinal direction. Although the figures only show two opposing LED light sources, there may also be arranged more than 2 LED's. In the claims, the word "comprising" does not exclude other elements or steps and the indefinite article "a" or "an" does not exclude a plurality. The mere fact that certain measures are recited in mutually different dependent claims does not indicate that a combination of these measures cannot be used to advantage. In particular, the features of claims 7 to 11 can be freely combined with the features of all preceding claims. Any reference signs in the claims should not be construed as limiting the scope of the claims.

LIST OF REFERENCE SIGNS

1 metal plate
2 LED
3 heat sink
4 heat sink
5 fan
6 fan
7 cooling fin
8 gap
9 fan axis
10 LED lamp unit
11 reflector
12 emission direction
13 reference/separation plane
14 internal air domain
15 support member
16 electrical connector base

The invention claimed is:

1. An LED lamp unit for an automobile, comprising:
an electrical connector base;
a first heat sink connected to the electrical connector base;
a common plate-like mounting member having a first end connected to the first heat sink;
a first LED light source arranged on a first side of the common plate-like mounting member to emit in a first half space;
a second LED light source arranged on a second side of the common plate-like mounting member to emit in a second half space; and
a second heat sink connected to a second end of the common plate-like mounting member, wherein:
each heat sink comprises a tapered end facing the first and the second LED light sources; and
the first and the second LED light sources are in between the first and second heat sinks.

2. The LED lamp unit according to claim 1, wherein each heat sink further comprises (1) cooling fins parallel to the common plate-like member, (2) a distal end away from the first and the second LED light sources, and (3) a fan arranged at the distal end.

3. The LED lamp unit according to claim 2, wherein each fan is arranged to generate a flow of cooling gas through gaps between the cooling fins towards the first and the second LED light sources.

4. The LED lamp unit according to claim 3, wherein each heatsink comprises sidewalls and the cooling fins span the sidewalls, the gaps between the cooling fins are opened towards the first and the second LED light sources to blow the cooling gas toward the first and the second LED light sources.

5. The LED lamp unit according to claim 1, wherein the common plate-like mounting member is formed integrally with at least one of the first and the second heat sinks or is in direct mechanical contact with at least one of the first and the second heat sinks.

6. The LED lamp unit according to claim 1, wherein the common plate-like mounting member is a metal plate.

7. The LED lamp unit according to claim 1, wherein the first and the second LED light sources are white color LEDs.

8. An automotive lamp comprising the LED lamp unit of claim 1 and a reflector at least partly surrounding the LED lamp unit, wherein the automotive lamp unit is a headlamp or signaling lamp.

9. The automotive lamp of claim 8, wherein the reflector is a parabolic reflector.

10. The automotive lamp of claim 8, wherein the LED lamp unit is completely arranged inside a volume at least partly surrounded by the reflector, such that light emitted by the first and the second LED light sources is directed by the reflector towards a light emission direction of the automotive lamp.

11. A headlamp or signaling lamp, comprising:

a reflector; and a LED lamp unit comprising a portion completely arranged inside a volume surrounded by said reflector, the portion comprising:

a common plate-like mounting member;

LED light sources arranged on two opposite sides of the common plate-like mounting member;

a first heat sink, comprising:

a first tapered end facing the LED light sources and being connected to one end of the common plate-like mounting member; and cooling fins; and a second heat sink, comprising:

a second tapered end facing the LED light sources and being connected to an opposite end of the common plate-like mounting member from the second heat sink, wherein the LED light sources are in between the first and second heat sinks.

12. The headlamp or signaling lamp according to claim 11, wherein the first heat sink further comprises:

a distal end away from the LED light sources; and a fan arranged at the distal end.

13. The headlamp or signaling lamp according to claim 11, wherein the first heat sink further comprises sidewalls, the cooling fins spanning the sidewalls.

* * * * *